United States Patent [19]

Mori et al.

[11] 4,079,632

[45] Mar. 21, 1978

[54] MECHANISM FOR DRIVING THE NIPPER SHAFT OF A COMBER

[75] Inventors: Mitsuo Mori, Toyota; Ohashi Kengo, Takahama, both of Japan

[73] Assignee: Kabushiki Kaisha Toyoda Jidoshokki Seisakusho, Japan

[21] Appl. No.: 712,742

[22] Filed: Aug. 9, 1976

[30] Foreign Application Priority Data

Aug. 14, 1975 Japan ..... 50-98068

[51] Int. Cl.[2] ..... F16H 21/16; D01G 19/16

[52] U.S. Cl. ..... 74/25; 19/225

[58] Field of Search ..... 74/25, 96; 19/115, 225

[56] References Cited

U.S. PATENT DOCUMENTS

| | | | |
|---|---|---|---|
| 854,240 | 5/1907 | Rine | 74/25 |
| 3,307,583 | 3/1967 | Harter | 74/96 |
| 3,785,282 | 1/1974 | Kamelander | 74/25 |

*Primary Examiner*—Benjamin W. Wyche
*Assistant Examiner*—Wesley S. Ratliff, Jr.
*Attorney, Agent, or Firm*—Burgess, Ryan and Wayne

[57] ABSTRACT

A mechanism for driving the nipper shaft of a comber provided with a plurality of combing units, wherein a driving shaft and a nipper shaft are extended along the longitudinal direction of the comber. An eccentric disc is rigidly mounted on the driving shaft. A slider link motion mechanism is provided with a slider connected to the eccentric disc in such a condition that the slider is capable of reciprocally displacing along its own displacing passage when the eccentric disc is driven. One of the link elements of the slider link motion mechanism is slidably engaged with the slider so that a swing motion about a fulcrum thereof is created. The other link element of the above-mentioned mechanism is mounted on the swing shaft and, therefore, a quick return motion of the reciprocal turning motion of the swing shaft can be created.

4 Claims, 12 Drawing Figures

MECHANISM FOR DRIVING THE NIPPER SHAFT OF A COMBER

SUMMARY OF THE INVENTION

The present invention relates to a mechanism for driving the nipper shaft of a comber which creates a swing motion of a swing lever rigidly mounted thereon.

It is well known that a comber is utilized in a preparatory process for producing high quality yarns, whereby short fibers, trash and neps are removed from useful fibers and the arrangement of individual fibers in a sliver is very much improved. In the operation of a comber, the combing action on fiber tufts by the needles on the cylindrical surface of the revolving cylinder is important to attain the purpose of the combining process. However, the forward and backward reciprocating displacing motion of the nipper, whereby the combed fiber tufts are transferred to the detaching roller, is also very important. In the combing operation, the fiber tuft gripped by the nipper, which comes to a terminal position of its backward displacing motion, receives the combing action of the needles of the cylinder. Thereafter, the combed fiber tuft gripped by the nipper must be transferred from the nipper to the detaching roller means at the terminal position of the forward displacing motion of the nipper. Therefore, to impart a very effective combing action of the needles on the cylinder to the fiber tuft gripped by the nipper and to carry out the above-mentioned transfer motion of the combed fiber tuft from the nipper to the detaching roller means very smoothly, it is desirable to create a very slow forward displacing motion of the nipper from the terminal of the backward displacing motion.

It is well known that a so-called link motion mechanism can be utilized for creating the reciprocal forward and backward displacing motion of the nipper. The four bar link motion mechanism is well known as a very simple mechanism for converting an input of a revolving motion to an output in a form of a reciprocal turning motion. However, in the above-mentioned output of the link motion mechanism, the speed difference between the forward displacing motion and the backward displacing motion is very small, and it is impossible to stop the nipper at a position adjacent to the terminal of the backward displacing motion thereof for a desirably long period of time, which is required for carrying out an effective combing action by the needles. Therefore, the above-mentioned four bar link motion mechanism can not be used as a mechanism for creating the desirable reciprocal forward and backward displacing motion of the nipper. Several modifications of the four bar link motion mechanism have been proposed for creating the desirable swing motion of the swing lever secured to the nipper shaft. For example, with a link motion mechanism comprising the above-mentioned four bar link motion mechanism and a plurality of links additionally applied to the four bar link motion mechanism, an attempt was made to attain the above-mentioned purpose. However, it was found that such modification of the four bar link motion mechanism makes the construction of the driving mechanism of the nipper shaft very complicated and reduces the working accuracy of the swing motion of the swing lever secured to the nipper shaft. The above-mentioned problems resulting from the use of the modified four bar link motion mechanism are serious in that they impede the adoption of such a link motion mechanism for the so-called high speed comber, wherein very high production efficiency with very fine combing effect are required. This is because if a crank mechanism is applied in the above-mentioned modified four bar link motion mechanism, the higher the driving speed of the link motion mechanism, the stronger the force imparted to pins connecting the links and crank and, consequently, different parts of the modified link motion mechanism may possibly be broken.

It is the purpose of the present invention to provide a novel mechanism for driving the nipper shaft of a comber, whereby a desirable quick return swing motion of the swing lever secured to the nipper shaft can be created, and the above-mentioned problems of the conventional driving mechanism can be solved even if the driving speed of the comber is greatly increased.

To attain the purpose of the present invention, the mechanism for driving the nipper shaft according to the present invention comprises an eccentric disc secured on a driving shaft such as a cylinder shaft, a combination of a link motion mechanism and a slider mechanism comprising a slider and a guide means for the slider, and a mechanism for transmitting the output of the above-mentioned combination of the slider and link motion mechanism to a nipper shaft; the motion of the combined mechanism of the slider and the link motion mechanism is actuated by the turning motion of the eccentric disc by way of the slider. According to the above-mentioned mechanism, the preferable motion of the nipper which involves a quick return motion can be created so that an effective combing action upon a fiber tuft and also an effective fiber tuft transfer operation are achieved.

DETAILED EXPLANATION OF THE INVENTION

The mechanism for driving the nipper shaft of the comber according to the present invention is hereinafter explained by an embodiment thereof shown in FIGS. 1 through 4.

Figure 1:
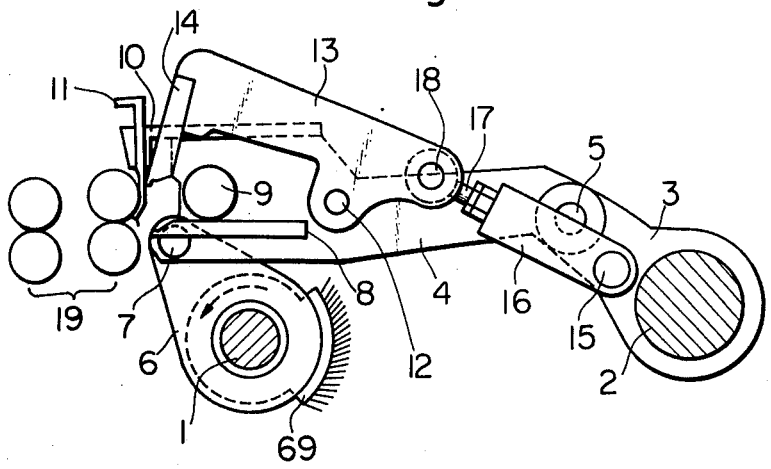
FIG. 1 is a schematic side view of a combing unit of the conventional comber.

Referring to FIG. 1, a common cylinder shaft 1 and a common nipper shaft 2 are utilized for all combing units of a comber and are arranged along the longitudinal direction of the comber in parallel condition to each other. The cylinder shaft 1 is connected to a driving source (not shown) so as to be positively driven. In each combing unit, a combing cylinder 69 is rigidly mounted on the cylinder shaft 1 by means of a key. The nipper shaft 2 is reciprocally turned in clockwise and counterclockwise directions. A swing lever 3 is secured at one and on the nipper shaft 2 and connected at the other end to a rear end of a nipper frame 4 by way of a pin 5. A front end of the nipper frame 4 is connected to a front end of a rocker arm 6, which arm is turnably mounted on the cylinder shaft 1 by way of a metallic element. A cushion plate 8 is mounted on the nipper frame 4, a feed roller 9 is arranged on the cushion plate 8 and a top comb 11 is mounted on a front end of a plate 10 secured to an upper end of the nipper frame 4. Further, a nipper arm 13 is mounted on a middle portion of the nipper frame 4 by way of a pin 12 and the nipper arm 13 is provided with a nipper knife 14 which is secured to the front end thereof. In each combing unit the fiber tuft can be held by the nipper knife 14 and the cushion plate 8 in such a way that the fiber tuft is gripped between the nipper knife 14 and the cushion plate 8. A turn buckle 16 is turnably mounted at its one end on a part of the swing lever 3 by means of a pin 15 and the rear end of the nipper arm 13 is turnably connected to one end of a connecting bar 17 by means of a pin 18. The other end of the connecting bar 17 is screwed into the other end of the turnbuckle 16. Consequently, when the nipper shaft 2 is reciprocably turned, the nipper frame 4 is displaced reciprocally toward the forward and rearward direction. During the above-mentioned reciprocal motion of the nipper frame 4, when the nipper frame 4 comes to a position adjacent to a terminal position of the rearward displacing motion thereof, the nipper knife 14 is capable of gripping a fiber tuft in stable condition together with the cushion plate 8 at a position therebetween. Consequently it is possible to impart an effective combing action to the fiber tuft gripped between the nipper knife 14 and the cushion plate 8. On the other hand, when the nipper frame 4 comes to a position adjacent to a terminal position of the forward displacing motion thereof, the above-mentioned gripping of the fiber tuft is released so as to transfer the combed fiber tuft to detaching rollers 19 disposed at an upstream position of the combination of the top comb 11 and the nipper knife 14.

Figure 2:
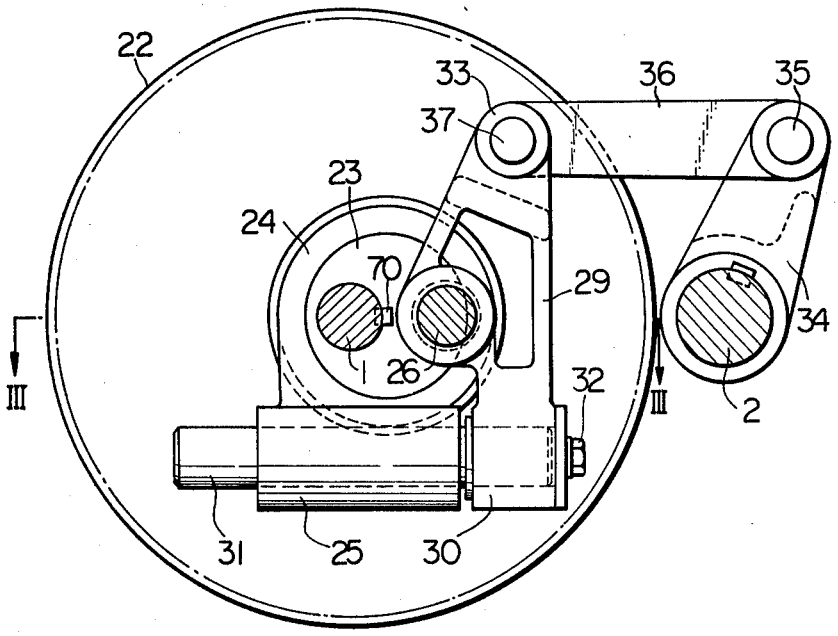
FIG. 2 is a schematic side view of a mechanism for driving a nipper shaft of the combing unit shown in FIG. 1, according to the present invention.
Figure 3:
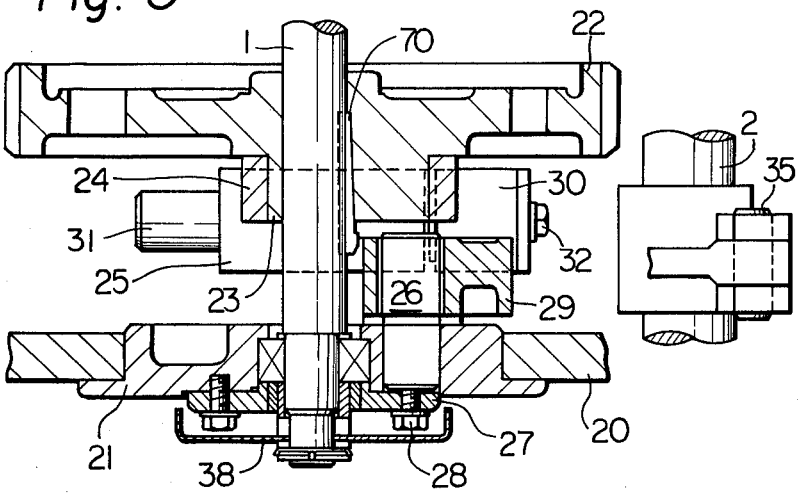
FIG. 3 is a sectional plan view of the driving mechanism, taken along a line III—III in FIG. 2.
Figure 4:
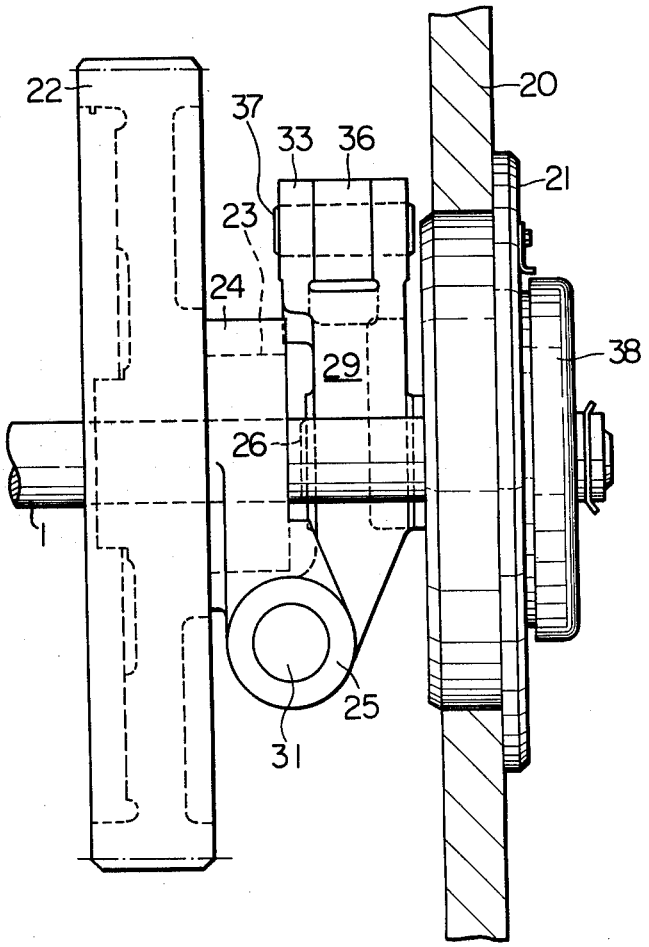
FIG. 4 is a schematic front view of the driving mechanism shown in FIG. 2.

The mechanism for driving the nipper shaft 2 utilized for the above-mentioned embodiment is shown in FIGS. 2 through 4. As shown in these drawings, an end portion of the cylinder shaft 1 is supported by a disc 21 rigidly mounted on a machine frame 20 by way of a bearing. A gear 22 is secured to the cylinder shaft 1 by means of a key 70, and the gear 22 is provided with an eccentric disc 23 projected from the boss thereof. A cylindrical slider 25 is projected downward from a housing 24 which engages with the eccentric disc 23. A turnable supporting shaft 26 is arranged in parallel condition to the cylinder shaft 1. An end portion of the shaft 26 is engaged into the disc 21 in such a condition that the shaft 26 is fixed to the disc 21 by a bolt 28 by way of a cap 27 secured to the disc 21, while a two way lever 29 is turnably mounted on the other end portion of the supporting shaft 26. An end portion 30 of the two-way lever 29 is positioned at a position facing the cylindrical slider 25, and is provided with an aperture passing therethrough. An end of a guide bar 31 is engaged in the above-mentioned aperture and the guide bar 31 is fixed to the lower end 30 by a bolt 32. The guide bar 31 engages with the cylindrical slider 25 in such a condition that the guide bar 31 is capable of sliding in the cylindrical slider 25. A free end 33 of the upper lever portion of the two-way lever 29, and a swing lever 34 secured to the nipper shaft 2 by means of a key, are connected to corresponding ends of a link 36 by means of pins 37 and 35, respectively. A member 38 shown in FIGS. 3 and 4 is a position fixing index.

Figure 9:
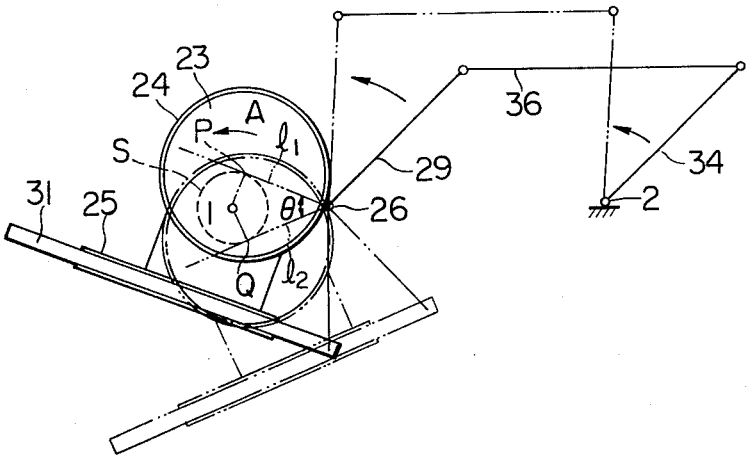
FIG. 9 is an operation-diagram of the driving mechanism shown in FIGS. 2 and 3.
Figure 12:
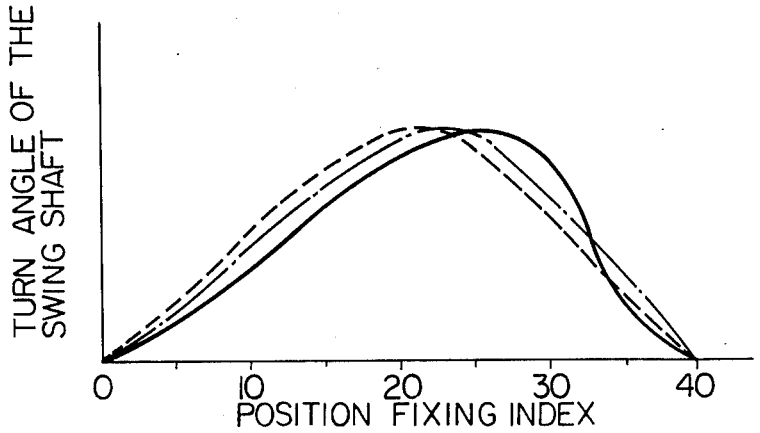
FIG. 12 is a diagram representing the relation between the reciprocal turning angle $\theta$ and the position fixing index.

The operational feature of the above-mentioned first embodiment of the present invention is hereinafter explained with reference to the operation diagram shown in FIG. 9. When the eccentric disc 23 is turned toward a direction represented by an arrow A according to the rotation of the cylinder shaft 1, the cylindrical slider 25 which is offset from the housing 24 is provided with a swing motion under the control action of the guide bar 31 which is capable of turning about the axial center of the supporting shaft 26. Since the guide bar 31 swings simultaneously together with the swing motion of the cylindrical slider 25, a swing motion characterized by the same swing angle as the swing motion of the slider 25 is transmitted to the two-way lever 29. In this case, the swing angle of the cylindrical slider 25 is represented by an angle $\theta$ defined by tangential lines $l$, $l'$ from an axial center of the supporting shaft 26 toward a trace circle S of an eccentric point of the eccentric disc 23. When the eccentric point comes to a point P on the tangential line $l_1$, the cylindrical slider 25, the guide bar 31, the two-way lever 29 and the swing lever 34 mounted on the nipper shaft 2 have been displaced to the terminal of the clockwise displacing motion thereof, respectively, as shown by the respective solid lines in FIG. 9. On the other hand, when the eccentric point comes to a point Q on the tangential line $l_2$, the above-mentioned elements 25, 31, 29 and 34 have been displaced to the terminal of the counterclockwise displacing motion thereof, respectively. As clearly shown in FIG. 9, that is, in the reciprocal turning motion of the nipper shaft 2 which corresponds to a swing motion of the cylindrical slide 25 in a swing angle $\theta$, the time required for the forward displacement from the point P to the point Q is quite a bit longer than the time required for the backward displacement from the point Q to the point P. Such reciprocal turning motion of the nipper shaft 2 is graphically represented by a solid line in the graph shown in FIG. 12, wherein the abscissa represents an index while the ordinate represents the swing angle $\theta$. From the trace of the solid line in FIG. 12, it is apparent that the desirable quick return motion of the nipper knife 14 can be created by the above-mentioned first embodiment of the present invention. To clarify the operational feature of the driving mechanism according to the present invention in comparison with that of the conventional parallel crank four bar link motion mechanism and also the modified mechanism of the parallel crank four bar link motion mechanism, the motion of the nipper shaft by means of the above-mentioned two link motion mechanisms are represented in FIG. 12.

That is, the dash line in the graph represents the condition of the conventional parallel crank four bar link motion mechanism, while the dot-dash line in the graph represents the condition of a combination of the conventional parallel crank four bar link motion mechanism and a plurality of links additionally applied thereto.

Therefore, it is clear that these two link motion mechanisms can not satisfy the requirement to attain the purpose of the present invention.

In the above-mentioned embodiment, the time difference between the time required for the above-mentioned forward displacement and the above-mentioned backward displacement of the nipper knife 14 can be adjusted by changing the distance between the axial center of the cylindrical shaft 1 and the axial center of the supporting shaft 26. In the above-mentioned first embodiment of the present invention, the two-way lever 29, the link 36, and the swing lever 34 are arranged so as to satisfy the condition necessary to form a so-called parallel crank four bar link motion mechanism and, therefore, the swing angle of the swing lever of the nipper shaft 2, or the turning angle of the nipper shaft 2, is identical to the swing angle of the cylindrical slider 25. However, it is not too hard to change the turning angle of the nipper shaft 2 by applying a modified four rod link motion mechanism formed with the above-mentioned elements 29, 36 and 34.

Figure 5:
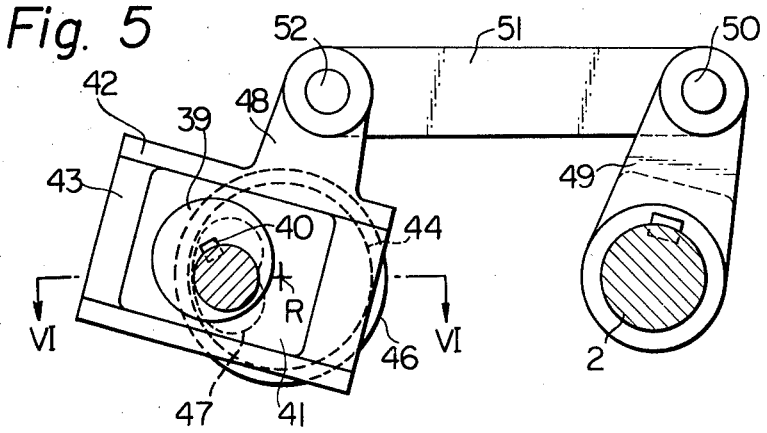
FIG. 5 is a schematic side view of a modified mechanism for driving a nipper shaft, according to the present invention.
Figure 6:
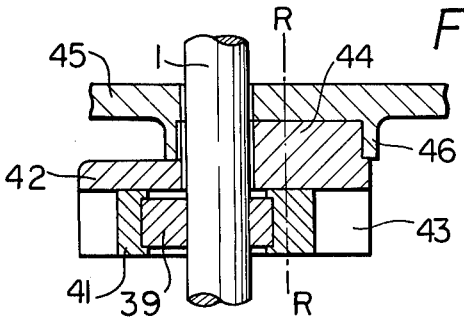
FIG. 6 is a sectional plan view of the driving mechanism, taken along a line VI—VI in FIG. 5.
Figure 10:
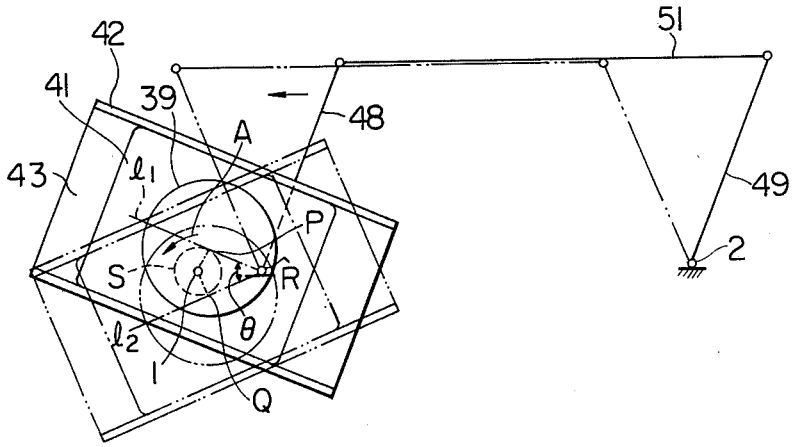
FIG. 10 is an operation-diagram of the driving mechanism shown in FIGS. 5 and 6.

A modified embodiment of the mechanism for driving the nipper shaft according to the present invention is hereinafter explained with reference to FIGS. 5, 6 and 10. In this embodiment, the cylinder shaft 1 and the nipper shaft 2 are arranged in parallel condition to each other. An eccentric disc 39 is secured on the cylinder shaft 1 by means of a key 40 and a slider 41 having a rectangular shape is slidably mounted on the eccentric disc 39. The slider 41 is slidably engaged in a rectangular guide groove 43 formed in a guide member 42. A cylindrical boss 44 is projected from the side of the guide member 42 opposite to the side of the guide groove 43. The boss 44 is slidably engaged in a cylindrical portion 46 projected from a machine frame 45 so that the boss 44 is capable of rotating about an axial center R spaced apart a predetermined distance from an axial center of the cylinder shaft 1. The cylinder shaft 1 passes through a guide member 42 and a slot 47 is formed in the guide member 42 so as to permit the turning motion of the guide member 42. An arm 48 is upwardly projected from the guide member 42 and a swing lever 49 is secured on the nipper shaft 2. The arm 48 and the swing lever 49 are connected to the corresponding ends of a link 51 by means of pins 52, 50, respectively.

The operational feature of the above-mentioned second embodiment of the present invention is hereinafter explained with reference to the operation diagram shown in FIG. 10. According to the rotating motion of the cylinder shaft 1 toward the direction represented by an arrow A, the trace of the eccentric point of the eccentric cam 39 is formed as represented by the dashed line circle S. Consequently, if tangential lines $l$, $l'$ are drawn from the axial center R of the guide member 42 to the trace circle S, when the eccentric point comes to the point P where the tangential line $l_1$ is tangent to the trace circle S according to the rotating motion of the eccentric disc 39, the guide member 42 has turned about the axial center R toward the clockwise direction as indicated by the solid line in FIG. 10. During this time, the arm 48, the link 51 and the swing lever 49 have been provided with their own swing motion in a way similar to the guide member 42, so that the nipper shaft 2 has been turned to the backward terminal of the reciprocal turning motion thereof. When the eccentric point comes to a point Q where the tangential line $l_2$, is tangent to the trace circle S, according to the rotational motion of the eccentric disc 39, the guide member 42 has been turned toward counter clockwise direction from the position represented by the solid line to the imaginary position represented by the two-dot dash line, so that the nipper shaft 2 has been turned to the axial position corresponding to the forward terminal of the swing motion of the swing lever 49 by way of the arm 48, the link 51 and the swing lever 49. Consequently, the nipper shaft 2 can be reciprocally turned between two axial positions corresponding to the positions of the guide member 42 represented by the solid line and the two-dot dash line. In other words, the nipper shaft 2 can be reciprocally turned between two axial positions where the axial angle between these positions is represented by $\theta$. The time required to forwardly turn the swing lever 49 from the position represented by the solid line to the position represented by the two-dot dash line about the nipper shaft 2 corresponds to the trace of the eccentric point from the point P to the point Q; while the time required to backwardly turn the swing lever 49 from the position represented by the two-dot dash line to the position represented by the solid line about the nipper shaft 2 corresponds to the trace of the eccentric point from the point Q to the point P. With regard to these two required times, the former time is definitely longer than the latter time. Consequently, the reciprocal turning motion of the nipper shaft 2 characterized by the solid line in the graph shown in FIG. 12 can be created.

Figure 7:
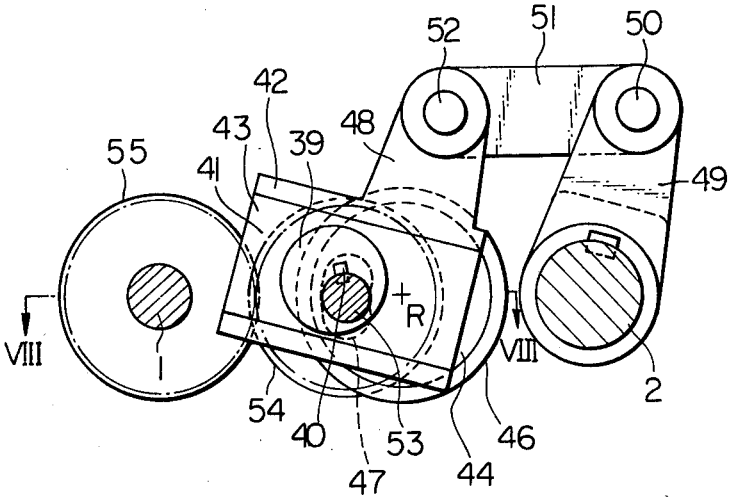
FIG. 7 is a schematic side view of the other modified mechanism for driving a nipper shaft, according to the present invention.
Figure 8:
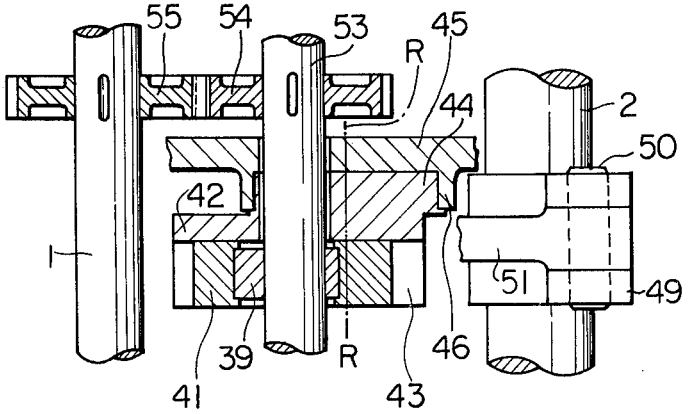
FIG. 8 is a sectional plan view of the driving mechanism, taken along a line VIII—VIII in FIG. 7.

The third embodiment of the driving mechanism, which is a modification of the above-mentioned second embodiment of the present invention, is hereinafter explained with reference to FIGS. 7 and 8. In this embodiment, the eccentric disc 39 is not mounted on the cylinder shaft 1. That is, an intermediate shaft 53 is disposed at a position between the cylinder shaft 1 and the nipper shaft 2 in parallel condition to these shafts 1 and 2. A gear 54 is secured on the intermediate shaft 53 by a key while a gear 55 is secured on the cylinder shaft 1 by a key. These gears 54 and 55 mesh with each other so as to transmit the driving power of the cylinder shaft 1 to the intermediate shaft 53. The eccentric disc 39 is secured to the intermediate shaft 53 by a key 40 and the rectangular slider 41 is slidably engaged with the eccentric disc 39. The guide member 42 is supported by a cylindrical portion 46 of the frame 45 in such a condition that the guide member 42 is capable of rotating about an axial center R. The rectangular slider 41 is slidably engaged in a guide groove 43 of the guide member 42. The arm 48 is upwardly projected from the guide member 42 and the swing lever 49 is rigidly mounted on the nipper shaft 2. The arm 48 and the swing lever 49 are connected to the corresponding ends of the link 51 by the respective pins 52 and 50 as shown in FIG. 7. Since the intermediate shaft 53 passes through the guide member 42, the slot 47 is formed in the guide member 42 so as to permit the turning motion of the guide member 42 due to the rotational motion of the eccentric disc 39. As mentioned above, the basic construction of this third embodiment is quite similar to that of the above-mentioned second embodiment and, consequently, the desirable quick return swing motion shown by the solid line curve in FIG. 12 can be created by the third embodiment of the present invention.

Figure 11:
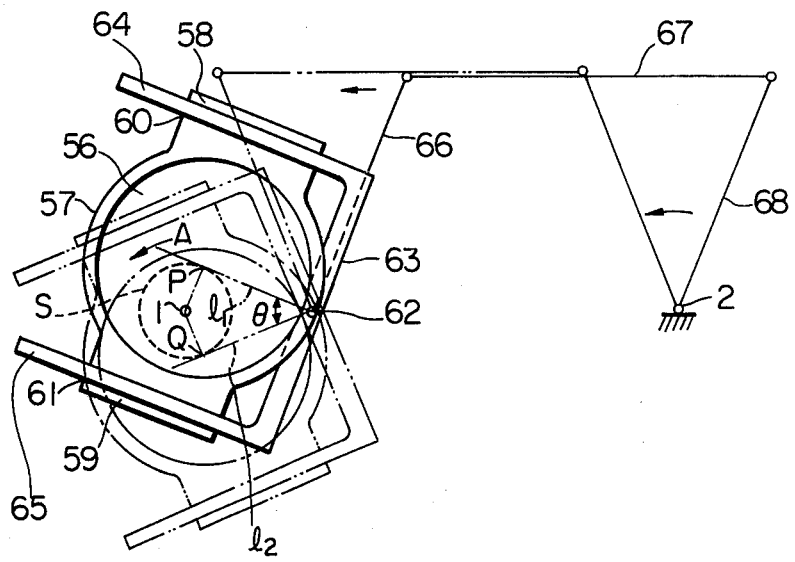
FIG. 11 is an operation-diagram of the driving mechanism comprising a combination of the first embodiment shown in FIGS. 2 and 3 with the second embodiment shown in FIGS. 5 and 6, according to the present invention.

The mechanism shown in FIG. 11 is a combination of the above-mentioned first and second embodiments. Therefore, this driving mechanism is hereinafter referred to as a fourth embodiment. In this fourth embodiment of the driving mechanism according to the present invention, an eccentric disc 56 is secured on the cylinder shaft 1 and a housing 57 is slidably mounted on the eccentric disc 56. A pair of sliders 58 and 59 are projected from the housing 57 in such a condition that the angular phase difference between these sliders 58 and 59 with respect to the imaginary axial center of the housing 57 is 180°. These sliders 58, 59 are provided with an aperture 60, 61 respectively. On the other hand, a shaft 62 is disposed at a position apart from the cylinder shaft 1 at a predetermined distance in parallel condition to the shaft 1. A guide member 63, having particular shape composed of a pair of straight guide arms 64 and 65 arranged in parallel condition and an intermediate arm which connects one end of each of the guide arms 64 and 65, is turnably mounted on the shaft 62 as shown in FIG. 11. The sliders 58, 59 are slidably engaged in the corresponding apertures 60, 61, respectively. A swing lever 66 is offset from the intermediate arm of the guide member 63, while another swing lever 68 is secured on the nipper shaft 2, and these swing levers are connected by means of a link 67.

In the above-mentioned fourth embodiment of the present invention, the reciprocal swing motion of the guide member 63 with a swing angle $\theta$ can be created when the eccentric disc 56 is rotated toward the direction represented by A in FIG. 11. This phenomenon is quite similar to the other embodiments of the present invention. The above-mentioned swing angle $\theta$ is defined as follows. That is, the angle, between a pair of tangential lines $l$, $l'$ drawn from the central axis of the shaft 62 to the trace circle S of an eccentric point of the eccentric disc 56 when the eccentric disc 56 rotates towards the direction represented by A in FIG. 11, is represented by the swing angle $\theta$. When the eccentric point of the eccentric disc 56 is positioned at a point P where the tangential line $l_1$ is tangent to the trace circle S, the guide member 63 is turned to the position shown by a solid line representation so that the nipper shaft 63 is turned to an angular position corresponding to a terminal of the backward displacing motion of the nipper frame. On the other hand, when the eccentric point of the eccentric disc 56 is positioned at a point Q where the tangential line $l_2$ is tangent to the trace circle S, the guide member 63 comes to a position represented by two-dot dash lines, so that the nipper shaft 63 is turned to an angular position corresponding to a terminal of the forward displacing motion of the nipper frame. Consequently, the time required for turning the nipper shaft 2 for carrying out the forward displacement of the nipper frame, which is represented by the arc along the trace circle S from the point P to the point Q, is longer than the time required for turning the nipper shaft 2 for carrying out the backward displacement of the nipper frame which is represented by the arc along the trace circle S from the point Q to the point P. Accordingly, the desired quick return swing motion of the swing arm 68 by the nipper shaft 2, which is represented by a solid line curve in FIG. 12 can be created by utilizing the driving mechanism of the fourth embodiment according to the present invention.

As mentioned above, the driving mechanism according to the present invention has a very simple construction so that the driving mechanism can be made compact. Accordingly, the driving mechanism of the invention can be disposed in an oil bath mounted on one side end portion of the comber so that perfect oiling of the driving mechanism can be carried out. It is a further benefitial feature of the driving mechanism according to the present invention that, since there are no members which require the cutting of the driving shaft, a very stable bearing assembly for supporting the driving shaft can be utilized. As a result of this, a very precise, effective combing action at a desirable high speed can be carried out.

What is claimed is:

1. A mechanism for driving a nipper shaft of a comber, comprising:

a rotatable driving shaft extending along the longitudinal direction of the comber and parallel to the nipper shaft;

a disc eccentrically mounted on the driving shaft for rotation therewith;

a first slider element adjacent said driving shaft and coupled to said disc for rotation therewith;

an arm having two ends and a pivot point therebetween, said arm being rotationally mounted to said disc at said pivot point, about an axis parallel to said driving shaft;

a second slider element fixed to one end of said arm and slidably engaging said first slider element;

a swing lever having one end affixed to said nipper shaft and another end remote therefrom; and a coupling link having one end pivotally connected to the other end of said arm, the other end of said link being pivotally connected to the other end of said swing lever, whereby during each revolution of said driving shaft said nipper shaft reciprocates slowly in one direction and rapidly in the other direction.

2. A mechanism for driving a nipper shaft of a comber according to claim 1, wherein said arm is provided with a guide bar comprising said second slider element, and said first slider element is a cylindrical slider wherein said guide bar is slidably engaged.

3. A mechanism for driving a nipper shaft of a comber according to claim 1, wherein said first slider element is provided with a rectangular outside shape, and said second slider element is a rectangular cut-out guide groove in said one end of said arm slidably engaging said first slider element, whereby when said driving shaft is driven, said slider element is reciprocally displaced along said guide groove so that quick return motion of said swing lever can be created.

4. A mechanism for driving a nipper shaft of a comber comprising a driving shaft extending along the longitudinal direction of the comber, an eccentric disc rigidly mounted on said driving shaft, a slider link motion mechanism provided with a slider connected to said eccentric disc in such a condition that said slider is capable of reciprocally displacing along its own displacing passage when said eccentric disc is driven and also provided with an arm slidably engaged with said slider, said arm being provided with a center for swinging thereof and provided with a function as a link of said slider link motion mechanism, a swing lever which functions as a link of slider link motion mechanism and is rigidly mounted on said nipper shaft arranged in a parallel condition to said driving shaft, said arm being a part of a guide member having a particular shape composed of a pair of straight guide arms arranged in parallel condition and an intermediate arm connecting one end of each of said guide arms, said intermediate arm is turnably mounted on pivot shaft, said slider is provided with a pair of guide apertures for slidably receiving a corresponding one of said straight guide arms, whereby when said driving shaft is driven, said intermediate arm is provided with a swing motion about said pivot shaft so that a quick return motion of said swing lever is created.

* * * * *